United States Patent [19]

Haugh

[11] Patent Number: 4,549,053

[45] Date of Patent: Oct. 22, 1985

[54] MICROWAVE DRYING DEVICE AND METHOD

[76] Inventor: Granger Haugh, 4551 Baja Mission Rd., Fallbrook, Calif. 92028

[21] Appl. No.: 472,485

[22] Filed: Mar. 7, 1983

[51] Int. Cl.[4] ..... H05B 6/78

[52] U.S. Cl. ..... 219/10.55 M; 219/10.55 A; 219/10.55 R; 34/1; 34/4; 159/DIG. 26; 203/100

[58] Field of Search ..... 219/10.55 M, 10.55 R, 219/10.55 A, 10.51, 10.65, 10.49 R; 34/1, 4; 159/3, DIG. 26, DIG. 1, DIG. 7; 203/40, 100; 264/25, 26

[56] References Cited

U.S. PATENT DOCUMENTS

| | | | |
|---|---|---|---|
| 2,473,539 | 6/1949 | Merriam | 159/DIG. 26 |
| 2,585,970 | 2/1952 | Shaw | 219/10.65 X |
| 3,171,009 | 2/1965 | Scheller et al. | 219/10.55 R |
| 3,273,629 | 9/1966 | Sargeant | 159/3 |
| 3,495,648 | 2/1970 | Amadon | 219/10.65 X |

FOREIGN PATENT DOCUMENTS

| | | |
|---|---|---|
| 218479 | 12/1954 | Austria . |
| 0039517 | 11/1981 | European Pat. Off. . |
| 233588 | 6/1907 | Fed. Rep. of Germany . |
| 250655 | 12/1945 | Switzerland . |

*Primary Examiner*—Philip H. Leung

*Attorney, Agent, or Firm*—Baker, Maxham, Callan & Jester

[57] ABSTRACT

Method and device in which a suspension in air or other gas of liquid droplets or fine particles containing an electromagnetic energy absorbent component is subjected to microwave radiation to apply energy to the droplets or particles as they fall to a collection point.

24 Claims, 1 Drawing Figure

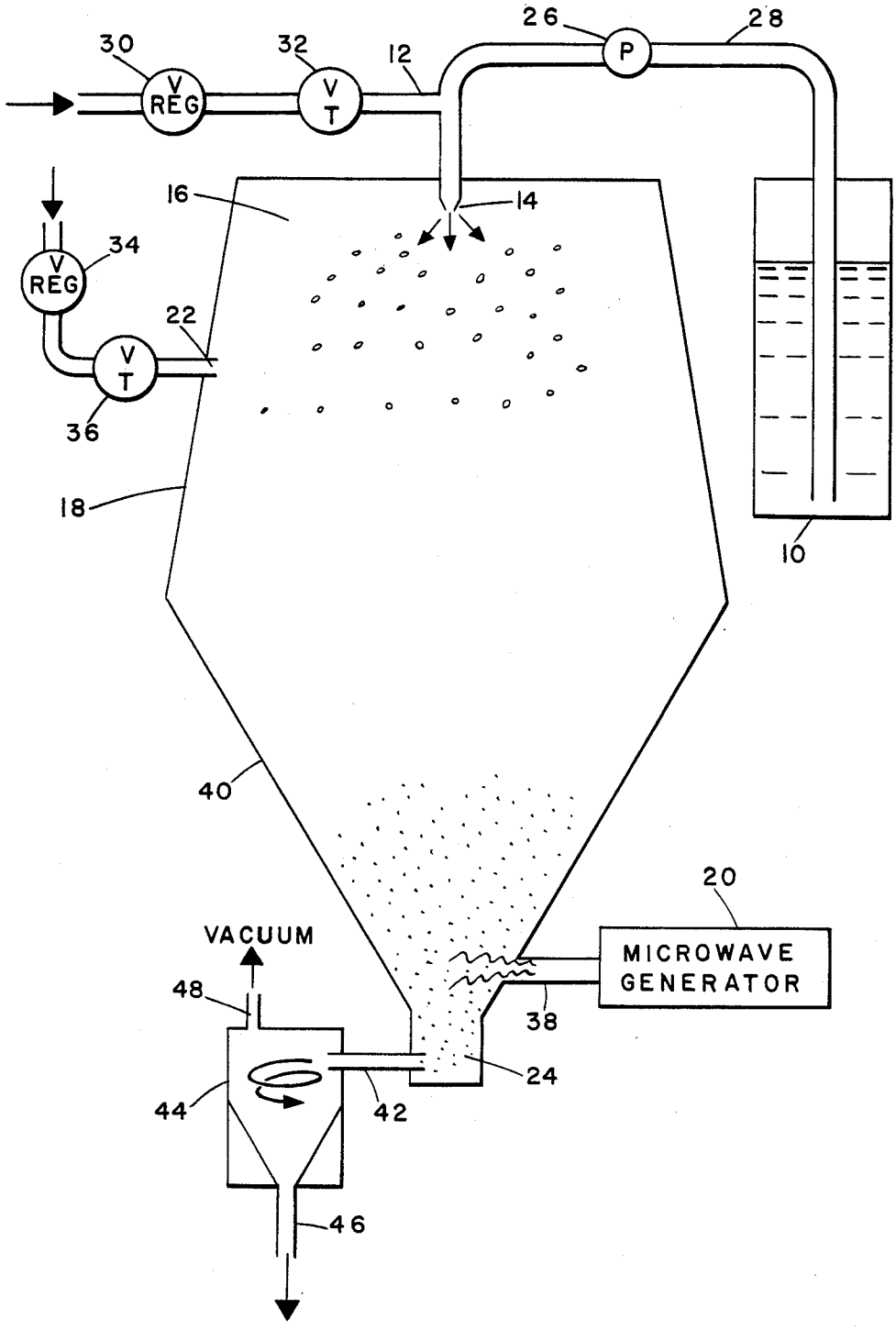
30
V
REG
32
V
T
12
26
P
28
16
14
34
V
REG
22
V
T
36
18
10
40
20
VACUUM
MICROWAVE
GENERATOR
48
38
24
44
42
46

MICROWAVE DRYING DEVICE AND METHOD

FIELD OF THE INVENTION

This invention relates to a method and device for drying liquids and particulate materials and particularly to a continuous flow process and device for applying energy to such material to remove a portion or all of a volatile component of the material.

BACKGROUND OF THE INVENTION

It is frequently desirable to remove a portion or all of the water or other liquid component of a substance in order to stabilize materials associated with the liquid. Examples of such processes are lyophilization and spray drying.

The process of lyophilization meets many of the desired goals. However, it requires that the sample be first frozen and then lyophilized in a high vacuum. See U.S. Pat. Nos. 3,721,725 and 3,932,943. Because of these several steps, the process requires considerable time. Also, the resultant product suffers from being inhomogeneous due to the uneven freezing and the resultant inhomogeneity of dissolved materials recovered from a frozen state. In addition, the product of lyophilization is characteristically very hygroscopic.

The process of spray drying requires the evaporation of water from droplets of spray by use of high temperature gases. The result is that heat sensitive elements in the treated material may become inactivated, denatured or hydrolized. The powder resulting from spray drying, however, is normally much less hydroscopic than the product of lyophilization.

BRIEF DESCRIPTION OF THE INVENTION

It is an object of the present invention to provide a method and device for uniform, rapid, controlled application of energy to liquid and particulate material, particularly for removing a portion or all of a volatile component from a nonvolatile.

In the method of the present invention, a suspension in air or other gaseous medium of liquid droplets or fine particles containing an electromagnetic energy absorbent component is subjected to electromagnetic radiation at a frequency strongly absorbed by that component to vaporize the droplets or particles as they fall to a collection point.

Apparatus, according to another aspect of the present invention, for carrying out the method includes a radiation chamber, a source for directing electromagnetic energy into the chamber and a material supply and spray device to introduce the material suspended in air or other gas into the chamber in which the components of the apparatus are constructed to coordinate the manner and rate of introducing material to be treated into the chamber, the geometry of the chamber, the frequency and power of the energy source and other components for cooperation to enable effective treatment of the material.

DESCRIPTION OF THE DRAWING

The invention will be described in connection with the attached drawing. In the drawing:

The FIGURE is a schmematic elevational view, partly in section of apparatus according to the invention.

DETAILED DESCRIPTION OF THE INVENTION

In the method of the present invention, the material to be treated is pumped at a controlled rate from a supply reservoir 10 and sprayed as a suspension in a gas supplied from pipe 12 by a nozzle 14 or other spray device in finely divided or mist like form into the upper portion 16 of the radiation chamber 18. The sprayed material then falls through the chamber 18 where an electromagnetic wave energy absorbent component of the material is engergized by electromagnetic wave energy supplied at the resonant frequency of the energy absorbent by the wave generator 20. The height through which the sprayed material falls in the radiation chamber 18 provides a falling time determined by the spray conditions and by control and direction of additional air or other gas introduced through a port 22 sufficient to effect the desired drying when the material reaches a collection point 24.

The method may be used wherever evaporation of a material containing an electromagnetic wave energy absorbent component is required. Thus the method may be used to remove volatile components or to effect a reaction while the particles or droplets are suspended in a gaseous medium.

A preferred form of the method is its use to evaporate a portion or all of a volatile component from a non-volatile component; and the following description will relate primarily to that form of the method.

Solutions, emulsions or dispersions in which water is the energy absorbent volatile component are most common and the description will ordinarily refer to such component as water. It is to be understood, however, that solutions or dispersions of non-volatile material in energy absorbent liquids other than water, such as alcohols, aliphatic and aromatic compounds, hetrocyclics such as piperidine or pyridine, or halogenated compounds like "freon" and other polar liquids are considered within the scope of the invention. Alternatively, materials in which the non-volatile component is the energy absorbent component and the volatile material is not absorbent may be treated in accordance with the present invention.

Where the sprayed material is droplets of a solution, emulsion or suspension of a non-volatile material in a wave energy absorbent volatile liquid such as water, the wave energy is absorbed by the liquid and serves to increase enormously the energy of the molecules of the liquid. This enables the escape from the surface of the droplets as a vapor and reduces the liquid content of the droplets. Due to the absorption of the electromagnetic radiation at the surface of the droplets, little energy is transmitted to the interior of the droplets and drying is effected with little or no heating of the dissolved or suspended non-volatile components. Also each tiny droplet sprayed is representative of the whole of the solution, emulsion or suspension. Accordingly, there is no introduction of inhomogeneity into the dried product as a result of the drying process.

Conditions within the system are controlled with respect to the properties and requirements of the material to be treated. Thus, for particularly heat sensitive materials, the radiation chamber 18 may be operated at reduced pressure to cause volatilization at lower temperatures or higher rate. And where the material is readily oxidized, the atomizing system and the radiation chamber may be supplied with a non oxidizing gas which is inert toward the material, e.g. helium or nitrogen. Conversely, the atomizing system and the radiation chamber 18 may be supplied with a gas reactive with the material under the conditions existing in the chamber. For example, the chamber 18 might be filled with hydrogen sulfide to introduce sulfhydryl groups into a material such as creatinine phosphate kinase when treating solutions of such materials in order to stabilize or protect them.

The apparatus of the present invention enables efficient practice of the method through components constructed to give coordination of the rate and fineness of dispersion of the material to be treated in the air or other gas, the frequency and strength of wave energy input, the geometry of the chamber 18 for resonance at the selected wave frequency and other conditions of operation with respect to the requirements of the material to be processed.

The reservoir 10, shown as a liquid reservoir, is provided to store material to be processed. Suitable temperature control means (not shown) may be provided to ensure that the material remains stable prior to treatment. A metering pump 26 is connected to withdraw material from the reservoir through the pipe 28 and supply it to the atomizing device, shown as the nozzle 14, in the radiation chamber 18 at a controlled rate determined by the character of the material, the dimensions of the chamber 18 and the strength of the electromagnetic source 20. Alternatively, the material in the reservoir 10 may be under pressure and this pressure may be used to drive material from the reservoir through the pipe 28 to the atomizing nozzle 14. At the atomizing nozzle 14, the material is mixed for spraying with a flow of gas which is provided at constant pressure by use of a pressure regulator 30 and adjusted to the proper flow rate by a needle valve 32 disposed in the pipe 12 leading from the gas supply to the nozzle.

The atomizing device or nozzle is chosen relative to the dimensions of the radiation chamber 18 to disperse the material as droplets or particles sufficiently fine to have a falling time in the chamber to enable the wave energy to supply the desired vaporization of the volatile material. The radiation chamber 18 has a geometry and dimensions resonant to the frequency of electromagnetic wave energy applied by the source 20, such as a magnetron, through the wave guide or horn 38 and is proportioned such that its vertical dimension provides a length of free fall of the sprayed material from the nozzle 14 to its collection area 24 which will give a falling time of the droplets or particles required for action of the radiation required to energize the sprayed material. The energization needed is determined by the necessity of avoiding destructive temperature rise in the sprayed material and the time required within this temperature limitation to effect the desired physical or chemical change.

Correspondingly, the electromagnetic wave source 20 is operable at a frequency strongly absorbed by a component of the material being processed. The strength of the wave source is selected to provide the necessary energy input to the falling droplets or particles within the temperature limitation imposed by the material being processed.

Also, the radiation chamber may have one or more additional electromagnetic energy sources (not shown) which may be disposed to provide plural zones through which the droplets or particles will pass; and where plural energy-absorbent components are present in the material to be treated, the energy sources may provide radiation at different frequencies matched to the different energy-absorbent components.

Additional gas may be supplied to the radiation chamber at a controlled rate by a flow or pressure regulator 34 and flow meter 36 for introduction through the port 22 in the wall of the radiation chamber 18 for mixture with the sprayed material. The additional gas may provide additional capacity for taking up volatile evaporated in the chamber. Also, this gas may be introduced in a direction to cause a swirling motion in the chamber to increase the time of treatment of material in the chamber. Additional materials, such as a powder to prevent caking of the product, solid diluents or other additives may be carried in the added gas for mixture with the product.

The material supply metering pump 26 is controlled to supply material at a rate determined by the character of the material and the cross section of the radiation chamber 18 and the energy supply and absorption factors of the system. The rate must not be so high as to cause significant merging of droplets nor to overload and cause overheating of the energy supply. A temperature monitor (not shown) on the energy supply may be arranged to cut off power from the magnetron tube in the event of overheating and to cut off supply of material at the same time to prevent introduction of liquid material in the absence of electromagnetic radiation.

In the radiation chamber 18 shown, the lower portion 40 is conical to direct the treated material to a discharge conduit 42 through which it passes to a cyclone collector 44 which separates the solid product and discharges it through the outlet 46.

Vacuum may be applied to the system through the port 48 in the cyclone collector to assist in the evaporation of the volatile component. Alternatively, the system may be operated at pressures above atmospheric by restricting discharge of gas.

The following examples are given to aid in understanding the invention, but it is to be understood that the invention is not limited to the particular procedure, materials, conditions or apparatus employed in the examples.

EXAMPLE 1.

The device used had a radiation drying chamber 29 inches in height and a diameter of 9 inches discharging into a cyclone collector. A microwave generator was connected to the chamber through a wave guide to supply electromagnetic radiation at approximately 2,450 mhz. The system was kept at reduced pressure by a commercial "Shop Vacuum" connected to the cyclone collector.

100 ml. of coffee solution at room temperature was pumped from the reservoir to the nozzle and sprayed as a fine mist in air into the chamber at the rate of 3 ml./min. with 2 liters/min. of air.

The product collected in the cyclone was a fine dry powder having a moisture content of only 5.07% and capable of solution in water to reform coffee showing no observable deterioration from the original solution.

EXAMPLE 2.

Using the same heating device as in Example 1, 135 ml. of human serum was sprayed into the radiation chamber at a rate of 1.5 ml./min. with an airflow of 4 liters/min.

The product was collected in the cyclone and discharged as a fine dry powder, having a moisture content of 5.2%. No apparent loss in quality was observed.

EXAMPLE 3.

A 15% Bovine Serum Albumin solution containing Horse Serum Cholinesterase was sprayed into the radiation chamber at a rate of 1.5 ml./min. using an airflow of 4 liters/min.

A fine dry powder having a moisture content of only 4.5% and showing no apparent degradation was collected.

EXAMPLE 4.

A diagnostic reagent for the determination of Lactate Dehydrogenase, containing the following:

$5.0\times10^{-2}$ moles/liter Phosphate buffer $2.3\times10^{-4}$ moles/liter Nicotinamide-adenine dinucleotide, reduced $6.2\times10^{-4}$ moles/liter Pyruvate was prepared in 50 ml. of distilled water containing 7.5 grams of Bovine Serum Albumin.

This solution was introduced into the radiation chamber at the rate of 1.5 ml./min. with an airflow of 6 liters/min.

The product recovered was a fine dry powder having a moisture content of 8.7%. There was no apparent harm to the material.

EXAMPLE 5.

Human Whole Blood was sprayed into a radiation drying chamber at the rate of 1.25 ml./min. with an airflow of 6 liters/min.

A fine powdered material showing no observable harm was collected.

EXAMPLE 6.

A solution of 15% Bovine Serum Albumin and 10% isopropanol was sprayed into the radiation chamber at the rate of 1.5 ml./min. and an airflow of 6 liters/min.

A fine dry powder having a moisture content of 5.4% and showing no observable degradation was collected.

I claim:

1. A method of drying a material containing an electromagnetic energy absorbent volatile component comprising the steps of:

forming a dispersion in a gaseous medium of droplets of the material;

subjecting the dispersed droplets to electromagnetic radiation in the microwave range, the radiation having a strength and duration sufficient to vaporize a substantial amount of the volatile component in the droplets without heating a non-volatile component of the material to a temperature which would chemically alter the non-volatile component; and collecting the remaining non-volatile component which has not been vaporized.

2. A method according to claim 1 wherein the material consists of a solution or suspension of the non-volatile component and the solution or suspension is dispersed in the gaseous medium to form a spray.

3. A method according to claim 2 wherein the spray is directed into a chamber having a construction resonant at the frequency of the electromagnetic radiation into which the radiation is directed through a wave guide.

4. A method according to claim 2 wherein spray is directed downwardly from a nozzle into the interior of a chamber.

5. A method according to claim 1 wherein the dispersion of droplets of the material is done inside a chamber and a second gaseous medium is introduced into the chamber.

6. A method according to claim 5 wherein the second gaseous medium is introduced into the chamber to alter the movement of the dispersion.

7. A method according to claim 6 wherein the second gaseous medium is introduced into the chamber in a direction and at a rate to cause swirling within the chamber to increase the time that the material in droplet form is subjected to the radiation.

8. A method according to claim 5 wherein the second gaseous medium introduced into the chamber contains an additive for mixture with the remaining non-volatile component.

9. A method according to claim 5 wherein the second gaseous medium is inert toward the material.

10. A method according to claim 5 wherein the second gaseous medium is reactive with a component of the material.

11. A method according to claim 1 wherein the dispersion of droplets of the material is done inside a chamber and the pressure inside the chamber is maintained at an elevated level.

12. A method according to claim 1 wherein the dispersion of droplets of the material is done inside a chamber and the pressure inside the chamber is maintained at a reduced level.

13. A method according to claim 1 in which the volatile component is water or a mixture of water and/or organic solvent.

14. A method according to claim 1 wherein the frequency of the radiation is selected which is strongly absorbed by the volatile component.

15. An apparatus for drying a material containing an electromagnetic energy absorbent volatile component and a non-volatile component which is chemically altered if heated above a predetermined temperature, comprising:

a chamber;

means for forming inside the chamber a dispersion in a gaseous medium of droplets of the material;

means for generating microwave radiation;

means for directing the microwave radiation into the chamber so that it radiates the dispersion of droplets;

means for controlling the dispersion and the generator means such that a substantial amount of the volatile component in the droplets is vaporized without heating the non-volatile component above the predetermined temperature; and means coupled to the chamber for collecting the remaining non-volatile component which has not been vaporized.

16. An apparatus according to claim 15 wherein the chamber has a construction resonant to the microwave radiation and the microwave directing means includes a wave guide.

17. An apparatus according to claim 15 wherein the material consists of a solution or a suspension of the non-volatile component in the volatile component, and the dispersion forming means includes:

a downwardly directed nozzle mounted in an upper end of the chamber;

means for supplying the material under pressure;

means for supplying the gaseous medium under pressure; and means connecting the material and gaseous medium supply means to the nozzle so that the material is sprayed into the chamber from the nozzle.

18. An apparatus according to claim 17 and further comprising means for introducing a second gaseous medium into the chamber.

19. An apparatus according to claim 18 wherein the means for introducing the second gaseous medium into the chamber is configured to dynamically alter the descending movement of the droplets.

20. An apparatus according to claim 19 wherein the means for introducing the second gaseous medium into the chamber is configured to induce swirling movement in the dispersion.

21. An apparatus according to claim 15 wherein the lower portion of the chamber is conical and the collection means includes a cyclone coupled to a discharge end of the conical portion of the chamber for separating the gaseous medium from the remaining non-volatile component.

22. An apparatus according to claim 15 wherein the controlling means includes a metering pump for delivering the material to the dispersion forming means.

23. An apparatus according to claim 15 and further comprising means for reducing the pressure inside the chamber.

24. An apparatus according to claim 15 and further comprising means for increasing the pressure inside the chamber.

* * * * *